US007819112B2

(12) United States Patent
Berg

(10) Patent No.: US 7,819,112 B2
(45) Date of Patent: Oct. 26, 2010

(54) STONE CUTTING DEVICE

(75) Inventor: Rollo G. Berg, Madrid, IA (US)

(73) Assignee: M & R Manufacturing, Madrid, IA (US)

( * ) Notice: Subject to any disclaimer, the term of this patent is extended or adjusted under 35 U.S.C. 154(b) by 62 days.

(21) Appl. No.: 12/020,310

(22) Filed: Jan. 25, 2008

(65) Prior Publication Data

US 2008/0210213 A1 Sep. 4, 2008

Related U.S. Application Data

(60) Provisional application No. 60/886,551, filed on Jan. 25, 2007.

(51) Int. Cl.
*B28D 1/26* (2006.01)

(52) U.S. Cl. ..... 125/23.01; 125/35

(58) Field of Classification Search ..... 125/23.01, 125/13.01, 35, 40

See application file for complete search history.

(56) References Cited

U.S. PATENT DOCUMENTS 2,613,661 A * 10/1952 Huber ..... 125/23.01
2,657,681 A * 11/1953 Gatzke ..... 125/23.01
2,723,657 A * 11/1955 Jones ..... 125/23.01
2,746,447 A * 5/1956 Petch ..... 125/23.01
2,779,324 A * 1/1957 Schlough et al. ..... 125/23.01
2,874,688 A * 2/1959 Biesanz, Sr. et al. ..... 125/23.01
3,161,190 A * 12/1964 Stephens et al. ..... 125/23.01
5,662,094 A * 9/1997 Giacomelli ..... 125/23.01
6,883,511 B1 4/2005 Tsao
6,948,489 B1 9/2005 O'Neal
7,021,306 B1 4/2006 Billings
7,055,516 B2 6/2006 Choi

OTHER PUBLICATIONS

Brickstop; Block and Paver Cutters; web page printout from website; dated Dec. 20, 2005.

* cited by examiner

*Primary Examiner*—Robert Rose

(57) ABSTRACT

A stone cutting device that utilizes first and second blade assemblies aligned within first and second support members. The first blade assembly is equipped with a source of hydraulic pressure that provides force to drive a blade downward. A second blade assembly meanwhile has a blade disposed within an opening of a table such that when a stone is placed on the table the blade does not contact the stone. Resilient members are placed underneath the table such that when pressure is applied from the blade of the first blade assembly the table and stone move downwardly to contact the blade of the second blade assembly thus providing pressure on either side of the stone in order to cut the stone or block.

17 Claims, 2 Drawing Sheets

STONE CUTTING DEVICE

CROSS REFERENCE TO RELATED APPLICATION

This application claims the benefit of U.S. Provisional Application No. 60/886,551 filed Jan. 25, 2007.

BACKGROUND OF THE INVENTION

This invention is directed toward a stone cutting device. More specifically, this invention relates to a portable stone cutting device.

When workers need to dispose of old stones or block many methods are used in accomplishing this feat. For example, saws or chisels may be used in order to crack or cut the stones or blocks into multiple pieces. While effective this is a time consuming process and oftentimes can result in injuries to an individual's hands and fingers. Thus, there is a need in the art for an improved manner in which stones and blocks are cut.

Therefore, a principal object of the present invention is to provide a hydraulically actuated stone cutting device.

Another object of the present invention is to provide a safe and efficient manner to cut blocks and stones.

These and other objects, features, or advantages will become apparent from the specification and claims.

BRIEF SUMMARY OF THE INVENTION

A stone cutting device having a frame with first and second support members that are in spaced relation. A first blade assembly is slidably disposed between the first and second support members via top and bottom supports. The top and bottom supports are in parallel spaced alignment and at least one spring and a source of hydraulic pressure is disposed therebetween. Additionally, a first blade is disposed within the first blade assembly and is able to be actuated by the source of hydraulic pressure. A second blade assembly also is slidably disposed between the first and second support members and has a second blade therein. The second blade assembly also has a table that is supported by a resilient member wherein the second blade is disposed within an opening in the table such that when a stone or block is placed on the table the second blade does not engage the stone. Then, when the source of hydraulic pressure is actuated the first blade engages the stone forcing the table to move downward against the resilient member and into engagement with the second blade causing pressure to be applied by both blades thus cutting the stone.

DETAILED DESCRIPTION OF THE PREFERRED EMBODIMENT

Figure 1:
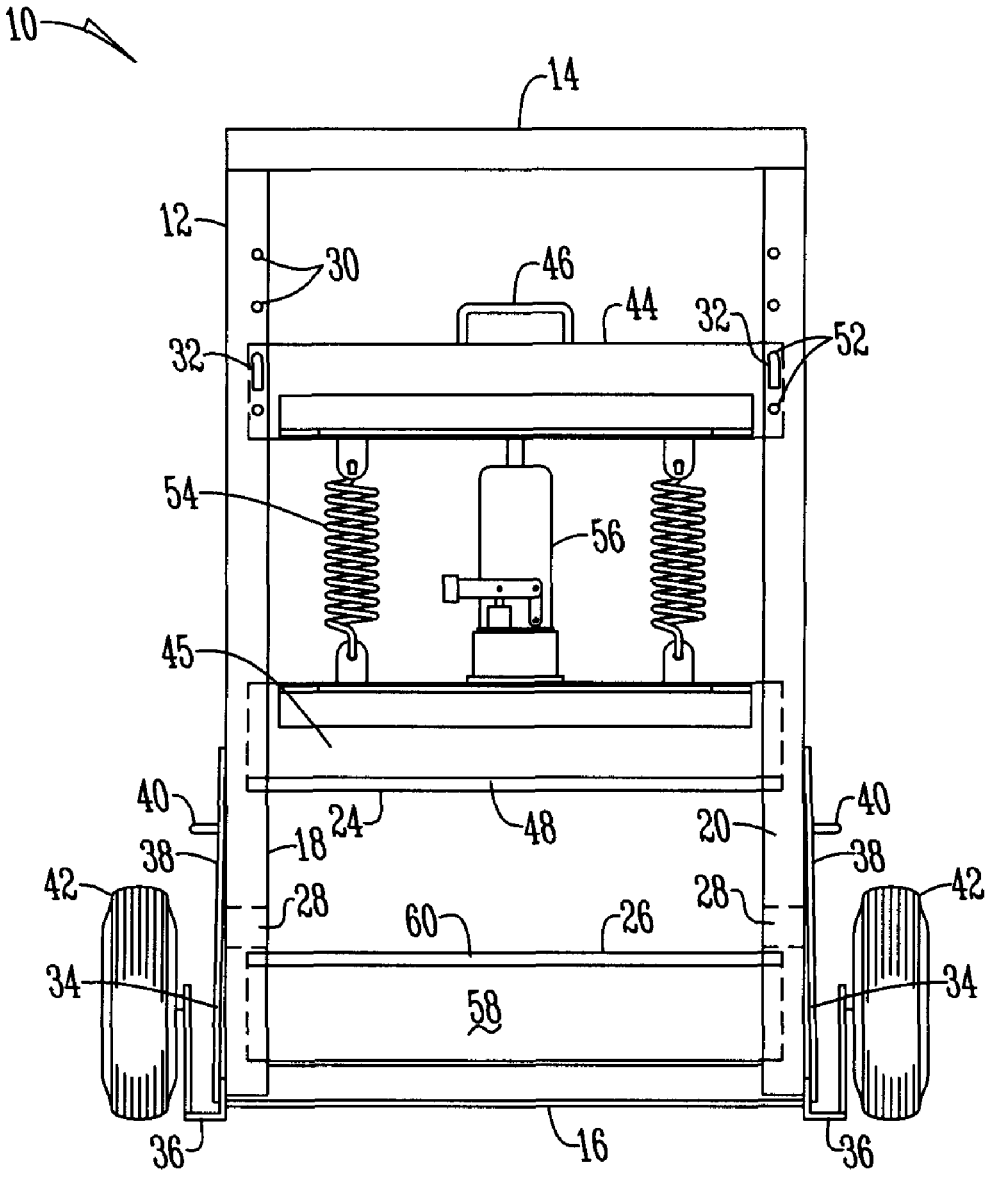
FIG. 1 is a front plan view of a stone cutting device.
Figure 2:
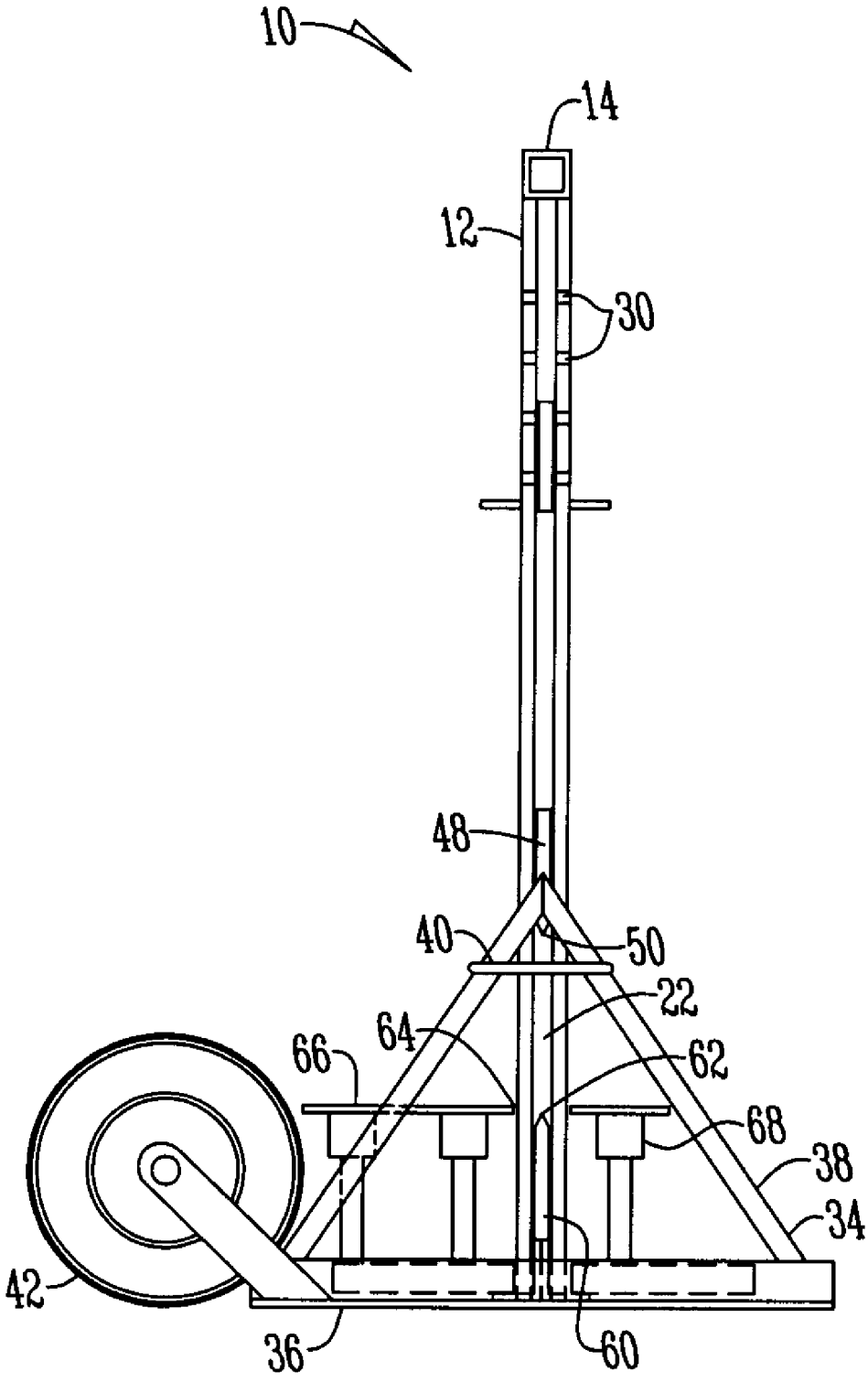
FIG. 2 is a side plan view of a stone cutting device.

The figures show a stone cutting device 10 that has a frame 12 with a top 14 and a bottom 16 brace in parallel spaced alignment that are connected to two frame support members 18, 20. The first and second support members 18, 20 have facing slots 22 that slidably receive a top or first blade assembly 24 and a bottom or second blade assembly 26. Disposed within the slots 22 is a stop 28 that is positioned such that the blade assemblies 24, 26 cannot touch.

A plurality of holes 30 are disposed within the support members 18, 20 that receive pins 32. In this manner the first blade assembly 24 is raised or lowered and then set to fit the size of stone whether the stone is 4", 6", 8" or 10".

To add stability, a pair of support legs 34 are attached to the support members. The support legs 34 have a pair of L-shaped members 36 connected to each frame support 18, 20 and the ground. Extending from each L-shaped member 36 and angled to connect to the frame supports 18, 20 are a pair of braces 38. A handle 40 is connected to and extends between each brace 38. Also, to transport, a retractable wheel 42 is pivotably mounted to the bottom brace 38.

The top blade assembly 24 has a pair of supports 44, 45 in parallel spaced alignment. Connected to the top support 44 is a handle 46 for use in raising and lowering the top assembly 24. The bottom support 45 has a blade 48 clamped within the support 45 with a cutting edge 50 that extends out of the bottom of the bottom support 45. Both the top and bottom supports 44, 45 extend into and are slidably received within the slots 22. The top support 44 also has apertures 52 that are selectively aligned with the pin holes 30 and receive pins 32 to set the position of the top blade assembly 24.

Connected to and extending between the top support 44 and the bottom support 45 are a pair of springs 54 and a source of hydraulic pressure 56. Preferred is a conventional 8-10 ton bottle jack.

The bottom or second blade assembly 26 has a blade support 58 that extends between and is slidably received within the slots 22. A blade 60 is clamped within the blade support such that a cutting edge 62 extends outwardly toward the top blade assembly. The bottom blade assembly 26 is positioned to fit within and extend through a slot 64 or opening in a table 66. The table 66 is mounted to the bottom brace 16 of the frame through a plurality of rubber bushings or pads 68. Alternatively, any resilient material or device is used to support the table. The table 66 is positioned such that in its natural state the cutting edge 62 of the bottom blade 60 lies in the same horizontal plane as the top surface of the table 66.

In operation the top blade assembly 24 is set based on the size of a stone or block. The assembly 24 is set by aligning the holes 52 (not shown) in the top support 44 with the holes 30 in the frame support members 18, 20 and inserting a pin 32 through both. The stone or block is then placed on the table 66. Once in position the bottle jack 56 is activated such that the top blade assembly 24 moves toward the block. As the cutting edge 50 of the top blade 48 engages the block pressure is placed upon the block such that the rubber bushings 68 contract, the table 66 lowers and the cutting edge 62 of the bottom blade 60 engages the block. As additional pressure is created by the jack 56, the blades 48, 60 move closer together until the stone breaks apart. Thus, cutting pressure is applied both to the top and bottom of the stone. Once completed the springs 54 bring the first blade assembly 24 back to its original position.

Thus, provided is a stone cutting device 10 that uses a hydraulic actuating force to cut stones. By having the resilient members 68 and positioning of the second blade 60, pressure is able to be applied to a stone or block in two directions making for an efficient and quick cutting of the stone or block. Additionally, because of use of the machine manual cutting and sawing is no longer needed thus minimizing the risk of injury. Consequently, at the very least all of the stated objectives have been met.

It will be appreciated by those skilled in the art that other various modifications could be made to the device without departing from the spirit in scope of this invention. All such modifications and changes fall within the scope of the claims and are intended to be covered thereby.

What is claimed is:

1. A stone cutting device comprising;

a frame having a top brace and a bottom brace connected by first and second support members in spaced relation wherein the first and second support members have a slot;

a first blade assembly slidably disposed within the slot of the first and second support members and having a first blade;

said first blade assembly having a top support and bottom support in parallel spaced alignment with at least one spring and a source of hydraulic pressure disposed therebetween;

a second blade assembly slidably disposed between the first and second support members and having a second blade;

said second blade assembly having a table supported by a resilient member wherein the second blade is disposed within an opening of the table;

wherein the top support is adjustably positioned adjacent the top brace;

wherein when a stone is placed on the table the second blade does not engage the stone; and wherein when the source of hydraulic pressure is activated the source of hydraulic pressure presses against the top support thereby forcing the bottom support downwardly wherein the first blade engages the stone forcing the table to move downward against the resilient member and into engagement with the second blade such that both the first and second blades apply pressure to the stone.

2. The stone cutting device of claim 1 wherein the source of hydraulic pressure is a bottle jack.

3. The stone cutting device of claim 1 wherein the height of the first blade assembly is adjustable.

4. The stone cutting device of claim 1 further comprising support legs having a pair of L-shaped members connected to first and second support members.

5. The stone cutting device of claim 1 wherein a retractable wheel is pivotably mounted to the frame.

6. The stone cutting device of claim 1 wherein the first blade assembly has a handle for raising and lowering the first blade assembly.

7. The stone cutting device of claim 1 wherein the resilient member is a rubber bushing.

8. The stone cutting device of claim 1 wherein the springs bring the first blade assembly back to an original position.

9. The stone cutting device of claim 1 wherein the second blade assembly is slidably disposed within the slot of the first and second support members.

10. The stone cutting device of claim 1 further comprising a stop positioned within the slot such that the first blade assembly and second blade assembly cannot touch.

11. The stone cutting device of claim 1 further comprising a stop positioned across the slot such that the first blade assembly and second blade assembly cannot touch.

12. The stone cutting device of claim 1 further comprising a handle connected to the top support for raising and lowering the first blade assembly.

13. The stone cutting device of claim 1 further comprising a base member connecting the bottom of the first and second support members having a pair of braces angularly extending between each base member and the first and second support member.

14. The stone cutting device of claim 1 further comprising a handle connected to and positioned outside of the first and second support members.

15. A stone cutting device comprising;

a frame having a top brace and a bottom brace connected by first and second support members in spaced relation wherein the first and second support members have a slot and a plurality of pin holes;

a first blade assembly slidably disposed within the slot of the first and second support members and having a first blade;

said first blade assembly having a top support and bottom support in parallel spaced alignment with at least one spring and a source of hydraulic pressure disposed therebetween wherein the top support has apertures that are selectively aligned with the pin holes in the first and second support members so as to raise or lower the height of the first blade assembly;

a second blade assembly slidably disposed between the first and second support members and having a second blade;

said second blade assembly having a table supported by a resilient member wherein the second blade is disposed within an opening of the table;

wherein the top support is adjustably positioned adjacent the top brace;

wherein when a stone is placed on the table the second blade does not engage the stone; and wherein when the source of hydraulic pressure is activated the first blade is forced downwardly where the first blade engages the stone forcing the table to move downward against the resilient member and into engagement with the second blade such that both the first and second blades apply pressure to the stone.

16. The stone cutting device of claim 15 wherein the source of hydraulic pressure presses against the top support thereby forcing the bottom support downwardly.

17. A stone cutting device comprising;

a frame having first and second support members in spaced relation wherein the first and second support members have a slot;

a first blade assembly slidably disposed within the slot of the first and second support members and having a first blade;

said first blade assembly having a top support and bottom support in parallel spaced alignment with at least one spring and a source of hydraulic pressure disposed therebetween;

a second blade assembly slidably disposed between the first and second support members and having a second blade;

said second blade assembly having a table supported by a resilient member wherein the second blade is disposed within an opening of the table;

a bottom support member connected to each of the first and second support members adjacent the bottom of the first and second support members;

a pair of braces angularly extending between the bottom support member and the first and second support members;

a pair of wheels rotatably connected to the first and second support members adjacent the bottom of the stone cutting device such that the stone cutting device is easily transported wherein when a stone is placed on the table the second blade does not engage the stone; and wherein when the source of hydraulic pressure is activated the first blade engages the stone forcing the table to move downward against the resilient member and into engagement with the second blade such that both the first and second blades apply pressure to the stone.

* * * * *